US008629750B2

(12) United States Patent
Spalding

(10) Patent No.: US 8,629,750 B2
(45) Date of Patent: Jan. 14, 2014

(54) FRACTIONAL AMP FUSE AND BRIDGE ELEMENT ASSEMBLY THEREFOR

(75) Inventor: Keith Allen Spalding, Fenton, MO (US)

(73) Assignee: Cooper Technologies Company, Houston, TX (US)

( * ) Notice: Subject to any disclaimer, the term of this patent is extended or adjusted under 35 U.S.C. 154(b) by 282 days.

(21) Appl. No.: 12/886,020

(22) Filed: Sep. 20, 2010

(65) Prior Publication Data

US 2012/0068809 A1 Mar. 22, 2012

(51) Int. Cl.
*H01H 85/04* (2006.01)

(52) U.S. Cl.
USPC ..... 337/297; 337/228

(58) Field of Classification Search
USPC ..... 337/228, 297
See application file for complete search history.

(56) References Cited

U.S. PATENT DOCUMENTS

| | | | | | |
|---|---|---|---|---|---|
| 1,028,328 | A * | 6/1912 | Christians | 337/229 |
| 1,036,510 | A * | 8/1912 | Murray | 337/297 |
| 1,099,589 | A * | 6/1914 | Cook | 337/297 |
| 1,508,839 | A * | 9/1924 | Dreyer | 337/297 |
| 1,511,838 | A * | 10/1924 | Ogle | 337/182 |
| 1,889,585 | A * | 11/1932 | Zodrow et al. | 337/293 |
| 1,927,905 | A * | 9/1933 | Slepian et al. | 337/159 |
| 1,971,809 | A * | 8/1934 | Bjorndal | 439/870 |
| 2,316,036 | A * | 4/1943 | Weil | 337/161 |
| RE23,219 | E * | 4/1950 | Moore, Jr. | 338/217 |
| 2,524,550 | A * | 10/1950 | Thom | 338/302 |
| 2,838,639 | A * | 6/1958 | Planer et al. | 338/62 |
| 2,873,327 | A * | 2/1959 | Bernstein | 337/160 |
| 2,877,321 | A * | 3/1959 | Jacobs, Jr. | 337/159 |
| 2,946,974 | A * | 7/1960 | Sias | 338/28 |
| 3,205,467 | A * | 9/1965 | Ganci | 338/268 |
| 3,447,240 | A * | 6/1969 | McClure, Jr. | 29/623 |
| 3,562,162 | A * | 2/1971 | Pitha | 501/142 |
| 3,838,374 | A * | 9/1974 | Knapp, Jr. | 337/163 |
| 3,870,863 | A * | 3/1975 | Ohnmacht | 219/532 |
| 3,912,903 | A * | 10/1975 | Northrup et al. | 392/350 |
| 4,084,145 | A | 4/1978 | Miller | |
| 4,237,440 | A * | 12/1980 | Miyasaka et al. | 337/227 |
| 4,563,809 | A * | 1/1986 | Reeder | 29/623 |
| 4,680,567 | A * | 7/1987 | Edwards | 337/164 |
| 4,929,921 | A | 5/1990 | Kalra et al. | |
| 5,003,280 | A | 3/1991 | Lopes | |
| 5,361,058 | A * | 11/1994 | Mosesian et al. | 337/163 |
| 5,418,516 | A * | 5/1995 | Oh | 338/21 |
| 5,903,208 | A * | 5/1999 | Sorger | 337/159 |
| 6,664,886 | B2 * | 12/2003 | Ackermann | 337/296 |
| 6,774,760 | B2 * | 8/2004 | Kalra et al. | 337/263 |
| 7,645,645 | B2 | 1/2010 | Hovis et al. | |
| 2002/0113684 | A1 * | 8/2002 | Arikawa et al. | 337/163 |
| 2007/0236323 | A1 * | 10/2007 | Schmidt et al. | 337/297 |

* cited by examiner

*Primary Examiner* — Anatoly Vortman
(74) *Attorney, Agent, or Firm* — Armstrong Teasdale LLP

(57) ABSTRACT

Fuse element and bridge assemblies include a length of fuse wire being wrapped around first and second end edges of a nonconductive bridge to define a winding around the nonconductive bridge element extending for at least one complete turn having a first linear segment and a second linear segment each extending entirely between the first end edge and the second end edge of the nonconductive bridge element. The winding of the fuse wire allows for construction of small fractional amp fuses with larger fuse element wires that are less prone to breakage in automated manufacturing processes.

24 Claims, 1 Drawing Sheet

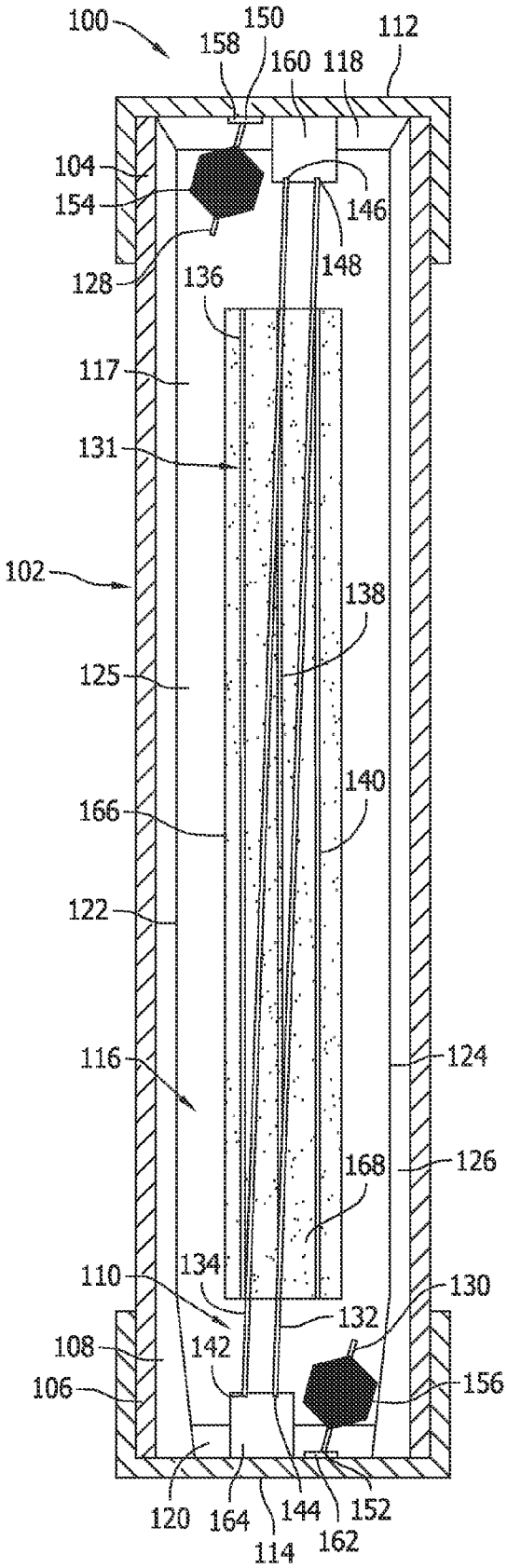
100
150
158
160
118
112
104
154
146
148
128
136
117
131
102
138
125
140
166
122
116
124
168
126
110
134
130
132
108
142
106
156
120
164
144
152
114
162

FRACTIONAL AMP FUSE AND BRIDGE ELEMENT ASSEMBLY THEREFOR

BACKGROUND OF THE INVENTION

The field of the invention relates generally to electrical fuses and related manufacturing methods, and more specifically to fractional amp fuses and manufacturing methods.

Fuses are widely used as overcurrent protection devices to prevent costly damage to electrical circuits. Conductive fuse terminals typically form an electrical connection between an electrical power source and an electrical component or a combination of components arranged in an electrical circuit. One or more fusible links or fusible elements, or a fuse element assembly, is connected between the fuse terminals and defines a conductive path (or paths) between the fuse terminals. When the fuse terminals are connected to line and load side circuitry, and when electrical current flowing through the fusible element or fuse elements exceeds a predetermined limit, the fusible elements melt and open the current path between the fuse terminals, and open one or more circuits connected through the fuse. Load side circuitry is therefore electrically isolated from line side circuitry to prevent damage to load side electrical components and circuitry.

Fuses are known having amperage ratings of about 1 Amp or less, and thus the fuse elements operate in response to relatively small currents flowing through the fuses. Such fuses typically involve thin wire fuse elements and are difficult to assemble as the wire fuse elements can be rather easily broken. While some attempt has been made to automate the assembly of such fuses, they have not been completely successful and improvements are desired.

BRIEF DESCRIPTION OF THE DRAWINGS

Non-limiting and non-exhaustive embodiments are described with reference to the following Figures, wherein like reference numerals refer to like parts throughout the various drawings unless otherwise specified.

FIG. 1 is a longitudinal cross sectional view of an exemplary embodiment of an overcurrent protection fuse.

DETAILED DESCRIPTION OF THE INVENTION

Assembling fuses involving thin wire fuse elements is difficult. Particularly, for small fractional amp fuses having amperage ratings of about 1 A or below, the thin wire elements needed to manufacture the fuses are quite delicate. Conventionally, such fuses have been assembled by hand because the wire fuse elements could not withstand automated processes without breaking.

Even for hand assembled fuses, however, the thin wire fuse elements present practical limitations on providing reliable small factional amp fuses in a cost effective manner.

For either man or machine, there tends to be a minimum wire size that provides a practical limitation on the ability to provide small fractional amp fuses of certain ratings. For example, using known manufacturing processes, fuse element wires having a diameter of less than 0.0007 inches are too easily broken and cannot be used with automated equipment. At present, for example, fuses having ratings of about 1 A can be automated using thin wire fuse elements, but not for small fractional having amperage ratings below about 1 A. Small fractional amp fuses having ratings well below 1 A, such as 0.1 A are not possible using known techniques because the wire fuse elements needed would be below the minimize size necessary for the automated equipment to handle without breaking.

For human assemblers, while persons may exist that have a high enough skill level to work with very small wire fuse elements without breaking them, they are not easily found. The more abundant worker to be found generally lacks the skill level to perform such work. Also, due to the tedious nature of the work involved, even if highly skilled workers could be found such fuses could not easily be produced in short order, in great supply, and at a cost point to meet the needs of the marketplace.

An exemplary embodiment of an overcurrent protection fuse 100 is shown in FIG. 1 in a longitudinal cross sectional view. As explained below, the fuse 100 advantageously overcomes the problems and disadvantages discussed above. Specifically, the fuse 100 is amenable to automated manufacturing processes in a relatively low cost manner while providing improved performance attributes and reliability of small fractional amp fuses. Method aspects will be in part apparent and in part specifically discussed in the following description.

The fuse 100 generally includes a nonconductive fuse body 102 having opposed first and second ends 104 and 106. The body 102 in the example shown is cylindrical or tubular and is hollow between the first and second ends 104 and 106. The hollow body 102 in the exemplary embodiment defines a cylindrical through-hole or bore 108 extending through the body 102 from the end 104 to the end 106. While in the embodiment shown, the bore 108 has a substantially constant internal diameter, in another embodiment the internal diameter of the bore 108 may be tapered or otherwise non-uniform along the axial length of the fuse body 102 measured in a direction coincident to a centerline of the bore 108 in the example shown.

In the exemplary fuse 100 shown, the body 102 is round on its outer circumference and is shaped as an elongated cylinder. The bore 108 is accordingly round on its inner circumference and is shaped as an elongated cylindrical opening. This need not be the case in all embodiments, however. It is contemplated, for example, that the body 102 and/or the bore 108 could have a non-circular circumference, and may be square or rectangular for example in other embodiments. The body 102 may be fabricated from known materials in the art using known techniques.

A fusible element 110 is located within the fuse body 102 in the bore 108 and completes an electrical connection between conductive terminal elements 112 and 114 attached to the respective ends 104 and 106 of the fuse body 106. In the example shown, the terminal elements 112 and 114 are provided in the form of ferrules. Alternative terminal structure is known, however, and may be provided in lieu of the ferrules 112 and 114 shown.

The fusible element 110 in the exemplary embodiment shown is a fine fuse wire that is wound for a number of turns on a generally elongated nonconductive bridge element 116. The bridge element 116 is a generally flat or planar body 117 fabricated from an electrically nonconductive material known in the art, and in the embodiment shown includes opposing first and second ends 118 and 120, and lateral side edges 122 and 124 interconnecting the ends 118 and 120. The body 117 also includes a first major surface 125 and a second major surface 126 opposing the first major surface 125.

The bridge element 116 extends axially within the fuse body 102 in the bore 108 for about the entire axial length of the fuse body 102. In other words, the opposing ends 118 and 120 of the bridge element 116 extend to the terminal elements 112, 114 at the opposing ends 104 and 106 of the fuse body 102. Further, the lateral side edges 122, 124 of the bridge element 116 are spaced apart by an amount nearly equal to the inner diameter of the bore 108 in the fuse body 102. As such, when the bridge element 116 is installed, the first and second major surfaces 125 and 126 effectively divide the bore 108 into two substantially equally sized compartments.

The wire fuse element 110 includes a first distal end 128, a second distal end 130 and a length 131 therebetween. The length 131 is wound around the bridge element 116 for a plurality of turns. Each of the plurality of turns includes substantially linear segments extending from the first end 118 to the second end 120 of the bridge element 116. More specifically, the length 131 of the fuse element wire 110 is strung on the bridge element 116 such that substantially linear segments 132, 134 of wire extend across the first major surface 125 of the bridge element, and substantially linear segments 136, 138, 140 extend across the second major surface 126 of the bridge element 116. The linear segments 132, 134, 136, 138 and 140 collectively define a multi-turn winding on the bridge element 116. The linear segments are connected by bends 142, 144 at the end 120 of the bridge element 116 and by bends 146, 148 in the end 118 of the bridge element 116. A bend 150 is further provided proximate the distal end 128 of the wire fuse element 110 at the end 118 of the bridge 116 and a bend 152 is provided proximate the distal end 130 at the end 120 of the bridge 116. Each bend 142, 144, 146, 148, 150 and 152 wraps around the bridge 116 from one of the major surfaces 125, 126 of the bridge 116 to the other of the major surfaces 125, 126.

In the example shown, the wire fuse element 110 extends on the bridge 116 as follows. The distal end 128 is retained to the bridge element proximate the end 118 of the bridge 116 on the first major surface 125 and the distal end 128 extends to the bend 150. The bend 150 wraps around to the second major surface 126 and the wire extends from the bend 150 as the linear segment 136 across the second major surface 126 to the end 120 of the bridge 116 and to the bend 142. At the bend 142 the wire wraps back to the first major surface 125 and extends across the first major surface 125 as the linear segment 134 to the end 118 of the bridge element 116 and to the bend 146. At the bend 146 the wire wraps back to the second major surface 126 and extends across the second major surface 126 as the linear segment 138 to the bridge end 120 and to the bend 144. At the bend 144, the wire wraps back to the first major surface 125 and across the first surface 125 as the linear segment 132 to the bend 146 at the end 118 of the bridge 116. At the bend 146, the wire wraps back to the second major surface 126 and across the second surface 126 as the linear segment 140 to the bend 152 at the end 120 of the bridge 116. The bend 152 wraps around back to the first major surface 125 foi a short distance to complete the winding.

As used herein, the turns of the winding refer to a complete revolution of wire around the bridge element 116 from end 118 to end 120. Thus, in the example shown, the fuse element 110 is wound for about 2 and ½ turns (two ½ turns extending on the first major surface 125 as represented by the segments 132 and 134 and three ½ turns extending on the second major surface 126 as represented by the segments 136, 138, 140). As described above, the linear segments forming the turns alternate from one of the major surfaces 125, 126 to the other as the winding is formed. Thus, a plurality of turns are provided on the bridge 116, with each of the major surfaces 125 and 126 provided with more than one of the linear segments. It is contemplated, however, that the number of turns may vary in different embodiments to accomplish different effects. Increasing the number of turns increases the effective length of the wire fuse element 110, and this in turn allows a larger diameter length wire to be used with comparable performance to a smaller diameter wire of a shorter length. The larger diameter wire, in turn, facilitates automated installation of the fuse element wire 110 without breaking it. The increased length of the fuse element 110 facilitates low amperage ratings for the completed fuse 100.

In the example shown, the distal end 128 of the fuse element 110 is retained in place with an attachment element 154 such as glue and the distal end 130 of the fuse element 110 is also retained in place on the bridge 116 with an attachment element 156 such as glue. Other attachment elements are known in the art, including but not limited to tape, and could likewise be used to retain the distal ends 128, 130 of the fuse element 110 in a desired position. In one example, the end 128 may first be glued in place, then the length 131 of the element 110 may be wound around the bridge 116 and the distal end 130 finally glued in place to provide a prefabricated fuse element 110 and bridge 116 assembly. This may be reliably accomplished in an automated manner with suitable machinery, and the prefabricated fuse element 110 and bridge 116 assemblies may be dropped in place in the fuse body 102 as the fuse 100 is assembled.

As further shown in FIG. 1, the bridge 116 may include a termination notch 158 and a winding notch 160 in the bridge end 118. The termination notch 158 is relatively shallow and positions the fuse element bend 150 close to the terminal 112 where it can be electrically connected thereto using solder or other techniques known in the art. The winding notch 160 is deeper than the termination notch 158 and creates a gap or space between the fuse element bends 146, 148 and the terminal element 112. That is, while the termination notch 158 facilitates electrical connection of the fuse element distal end 128 to the terminal element 112, the winding notch 160 serves to prevent any electrical contact of the fuse element 110 and the terminal element 112 apart from the distal end 128. As also shown in FIG. 1, the bends 146 and 148 in the winding notch 160 are separated or spaced from one another to prevent electrical shorting of the bends 146, 148 or associated linear segments in the winding. Structure may optionally be provided in the winding notch 160, such as a saw tooth edge, grooves or slots, or other features to facilitate spacing of the bends 146 and 148.

Likewise, the bridge 116 may include a termination notch 162 and a winding notch 164 in the bridge end 120. The termination notch 162 is relatively shallow and positions the fuse element bend 152 close to the terminal 114 where it can be electrically connected thereto using solder or other techniques known in the art. The winding notch 164 is deeper than the termination notch 162 and creates a gap or space between the fuse element bends 142, 144 and the terminal element 112. That is, while the termination notch 162 facilitates electrical connection of the fuse element distal end 130 to the terminal element 114, the winding notch 164 serves to prevent any electrical contact of the fuse element and the terminal element 114 apart from the distal end 130. As also shown in FIG. 1, the bends 142 and 144 in the winding notch 164 are separated or spaced from one another to prevent electrical shorting of the bends 142, 144 or associated linear segments in the winding. Structure may optionally be provided in the winding notch 164, such as a saw tooth edge, grooves or slots, or other features to facilitate spacing of the bends 142 and 144.

The bridge 116 may also be provided with an elongated and substantially rectangular opening 166 extending axially across the bridge body 116. The opening 166 is substantially centered between the lateral edges 122, 124 of the bridge 116, and extends for an axial length sufficient to expose the linear segments 132, 134, 136, 138, 140 extending on the major surfaces 125 and 126 of the bridge 116 and also across the opening 166. An arc quenching media 168, such as silica sand or another material known in the art, may fill the opening 166 and completely surround the linear segments 132, 134, 136, 138, 140 in the area of the opening 166. The arc quenching media 168 may further surround the bridge 116 and remaining portions of the fuse element 110 within the bore 108 in the fuse body 102.

The fuse element 110 and bridge 116 assembly described is amenable to bulk manufacturing techniques. Specifically, a roll of nonconductive material may be provided having a width equal to the axial length of the bridge body 116 measured between the ends 118, 120. A series of notches 158 and 160, the notches 162 and 164, and opening 166 may be pre-formed into the roll. A series of fuse elements 110 may be wound on the roll of material using one set of the notches 158, 160, 162, 164 and opening 166 formed in the roll. A spool of fuse wire may be provided such that a continuous fuse element wire may be strung about the bridge to form the windings, and thereafter cut as the windings are completed. After the fuse elements windings are completed on the bridge 116, the lateral edges 122 and/or 124 may severed from the roll to provide a discrete fuse element 110 and bridge 116 assembly. The discrete wire and bridge assemblies may then be dropped in place within the fuse bodies 102 and electrical connections completed to the terminals 112 and 114. All this may be done using automated equipment in a reliable manner without breaking the fuse element 110.

The diameter of the fuse element wire 110 may be selected to provide an amperage rating of about 1 A or less for the completed fuse. The fuse element 110 may be selected in various contemplated embodiments to provide an amperage rating of about 0.1 A to about 1 A. The fuse element wire 110 may have, for example, a diameter of about 0.0007 inches or more, while achieving subfractional fuse ratings that have conventionally been very difficult to produce in a reliable and cost effective manner, and that were previously thought to be incapable of being produced with automated equipment.

While a single fuse element 110 is shown, in further embodiments more than one fuse element may be provided on the bridge 116 and the fuse elements may be electrically connected to the terminals 112 and 114 in parallel with one another. Operation of the fuse element 110 may be further enhanced by using M-spot techniques and the like known in the art to vary the performance of the fuse element to interrupt overcurrent conditions in use.

The benefits and advantages of the fuse 100 are now believed to have been amply illustrated in connection with the exemplary embodiments disclosed.

An embodiment of a fuse has been disclosed including: a nonconductive body having opposing first and second ends; first and second conductive terminal elements coupled to the body at the respective first and second ends; a nonconductive bridge element having opposed first and second ends, the nonconductive bridge element extending axially within the fuse body between the first and second conductive terminal elements; and at least one wire fuse element including a first end, a second end and a length therebetween. The length is wound around the nonconductive bridge element for at least one complete turn, the turn including a first linear segment and a second linear segment extending entirely from the first end to the second end of the nonconductive bridge element.

Optionally, the nonconductive bridge element may include an elongated body having a first major surface and a second major surface opposing the first surface, with the first linear segment extending across the first major surface and the second linear segment extending across the second major surface. A third linear segment of the fuse element may extend across at least one of the first and second major surfaces. The third linear segment may be separated from one of the first and second linear segments on at least one of the first and second surfaces.

The fuse element length may optionally be wound for a plurality of complete turns, and a plurality of linear segments of the fuse element may extend across both of the first and second major surfaces. The first and second ends of the nonconductive bridge element may each include a notch, and a portion of the plurality of turns may extend in each notch.

An opening may extend through the nonconductive bridge element at a location spaced from the first and second ends. The opening may be elongated and may be rectangular. The nonconductive bridge element may include first and second lateral edges extending between the first and second ends, with the opening substantially centered within the first and second lateral edges. The linear segments of the fuse element may extend across the opening on both of the first and second major surfaces. The fuse may optionally include an arc quenching media filling the opening and surrounding the linear segments.

The fuse element may be configured to provide an amperage rating of about 1 A or less. The fuse element has an amperage rating of about 0.1 A to about 1 A. The fuse element has a diameter of about 0.0007 inches.

The fuse body may be substantially cylindrical, and the first and second terminal elements may be ferrules.

Another embodiment of a fuse has been disclosed including: a nonconductive fuse body; first and second conductive terminal elements coupled to the fuse body; an elongated nonconductive bridge element having opposed first and second ends respectively positioned proximate the first and second conductive terminals; and at least one wire fuse element including a first end, a second end and a length therebetween. The length is wound around the nonconductive bridge element for a plurality of turns extending between the first and second ends, wherein the fuse has a current rating of about 1 A or less.

Optionally, the fuse has a current rating of about 0.1 A or more. Each of the plurality of turns may include substantially linear segments extending from the first end to the second end of the nonconductive bridge element.

Still another embodiment of a fuse has been disclosed including: a nonconductive fuse body; first and second conductive terminal elements coupled to the fuse body; an elongated nonconductive bridge element having opposed first and second ends proximate the respective first and second conductive terminal elements; and at least one wire fuse element including a first end, a second end and a length therebetween. The length is wound around the nonconductive bridge element for a plurality of turns extending between the first and second ends, wherein the fuse has a current rating of about 0.1 A to about 1 A.

Optionally, each of the plurality of turns includes substantially linear segments extending from the first end to the second end of the nonconductive bridge element.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A fuse comprising:

a nonconductive body having opposing first and second ends;

first and second conductive terminal elements coupled to the body at the respective first and second ends;

a nonconductive bridge element having opposed first and second end edges, each of the first and second end edges of the nonconductive bridge including a termination notch and a winding notch spaced from the termination notch, the nonconductive bridge element extending axially within the fuse body between the first and second conductive terminal elements; and at least one wire fuse element including a first end, a second end and a length therebetween, the length of the at least one wire fuse element being wrapped once around each termination notch on each of the first and second end edges of the nonconductive bridge element, and being wrapped at least once around the winding notch in each of the first and second end edges of the nonconductive bridge element and therefore being wound around the nonconductive bridge element.

2. The fuse of claim 1, wherein the nonconductive bridge element comprises an elongated body having a first major surface and a second major surface opposing the first surface, the length of the at least one wire fuse element extending as a first linear segment extending across the first major surface from the termination notch on the first end edge to the termination notch on the second end edge, and the length of the at least one fuse fuse element extending as a second linear segment extending across the second major surface from the termination notch on the second end edge to the termination notch of the first end edge of the nonconductive bridge element.

3. The fuse of claim 2, wherein the length of the at least one wire fuse element further extends as a third linear segment extending across at least one of the first and second major surfaces.

4. The fuse of claim 3, wherein the third linear segment is separated from one of the first and second linear segments on at least one of the first and second end edges.

5. The fuse of claim 2, wherein the length of the at least one wire fuse element further is wrapped repeatedly around the nonconductive bridge to form a winding having a plurality of complete turns.

6. The fuse of claim 5, wherein the termination notch and the winding notch on each of the first and second end edges of the nonconductive body are differently sized.

7. The fuse of claim 1, wherein an opening extends through the nonconductive bridge element at a location spaced from the first and second ends.

8. The fuse of claim 7, wherein the opening is elongated.

9. The fuse of claim 8, wherein the nonconductive bridge element includes first and second lateral edges extending between the first and second end edges, the opening substantially centered within the first and second lateral edges.

10. The fuse of claim 8, wherein the opening is substantially rectangular.

11. The fuse of claim 8, wherein the length of the at least one fuse wire fuse element is extended across the opening.

12. The fuse of claim 8, wherein the nonconductive bridge element comprises an elongated body having a first major surface and a second major surface opposing the first surface, wherein the length of the at least one wire fuse element is extended across the opening on both of the first and second major surfaces.

13. The fuse of claim 8, further comprising an arc quenching media filling the opening and surrounding the length of the at least one wire fuse element proximate the opening.

14. The fuse of claim 1, wherein the at least one wire fuse element is configured to provide an amperage rating of about 1 A or less.

15. The fuse of claim 14, wherein the at least one wire fuse element has an amperage rating of about 0.1 A to about 1 A.

16. The fuse of claim 14, wherein the at least one wire fuse element has a diameter of about 0.0007 inches.

17. The fuse of claim 1, wherein the nonconductive body is substantially cylindrical.

18. The fuse of claim 1, wherein the first and second terminal elements comprise ferrules.

19. A fuse comprising:

a nonconductive fuse body;

first and second conductive terminal elements coupled to the fuse body;

an elongated nonconductive bridge element having opposed first and second end edges respectively positioned proximate the first and second conductive terminals, each respective one of the first and second end edges being formed with a termination notch and a winding notch, the termination notch and the winding notch being spaced from one another on each of the respective first and second end edges; and at least one wire fuse element including a first end, a second end and a length therebetween, the length being wrapped one time around the termination notch and wrapped a plurality of times around the winding notch on each of the first and second end edges, thereby defining a winding having a plurality of turns.

20. The fuse of claim 19, wherein the at least one wire fuse element provides a current rating of about 0.1 A to about 1 A.

21. The fuse of claim 19, wherein each of the plurality of turns includes substantially linear segments extending between the winding notch of the first end edge to the winding notch of the second end edge of the nonconductive bridge element.

22. A fuse comprising:

a nonconductive fuse body;

first and second conductive terminal elements coupled to the fuse body;

an elongated nonconductive bridge element having opposed first and second end edges proximate the respective first and second conductive terminal elements each of the first and second end edges being formed with a plurality of notches that are differently sized and spaced apart from one another; and at least one wire fuse element including a first end, a second end and a length therebetween, the length being wrapped around a first one of the plurality of notches at least once on each of the first and second end edges, and the length being wrapped at least twice around a second one of the plurality of notches on at least one of the first and second edges to define a winding around the nonconductive bridge element extending for a plurality of turns.

23. The fuse of claim 22, wherein each of the plurality of turns includes substantially linear segments extending between one of the plurality of notches on the first end edge and one of the plurality of notches on the second end edge.

24. The fuse of claim 22, wherein the fuse has a current rating from about 0.1 A to about 1 A.

* * * * *